US006783425B2

(12) United States Patent
McKeefery

(10) Patent No.: US 6,783,425 B2
(45) Date of Patent: Aug. 31, 2004

(54) SINGLE WIRE AUTOMATICALLY NAVIGATED VEHICLE SYSTEMS AND METHODS FOR TOY APPLICATIONS

(75) Inventor: James McKeefery, Milpitas, CA (US)

(73) Assignee: Shoot the Moon Products II, LLC, Pleasonton, CA (US)

( * ) Notice: Subject to any disclaimer, the term of this patent is extended or adjusted under 35 U.S.C. 154(b) by 41 days.

(21) Appl. No.: 10/277,862

(22) Filed: Oct. 22, 2002

(65) Prior Publication Data

US 2004/0035620 A1 Feb. 26, 2004

Related U.S. Application Data

(60) Provisional application No. 60/405,932, filed on Aug. 26, 2002.

(51) Int. Cl.[7] ..... A63H 30/02; A63H 30/04

(52) U.S. Cl. ..... 446/455; 180/167

(58) Field of Search ..... 180/167, 168, 180/169; 318/587, 576; 446/455

(56) References Cited

U.S. PATENT DOCUMENTS

| | | | |
|---|---|---|---|
| 2,847,080 | A | 8/1958 | Zworykin et al. |
| 3,147,817 | A | 9/1964 | De Liban |
| 3,468,391 | A | 9/1969 | Rushing et al. |
| 3,556,244 | A | 1/1971 | Gray |
| 3,606,933 | A | 9/1971 | Rushing et al. |
| 3,696,882 | A | 10/1972 | Martin |
| 4,162,869 | A | 7/1979 | Hitomi et al. |
| 4,354,235 | A | 10/1982 | Blakeslee |
| 4,486,694 | A | 12/1984 | Ohba et al. |
| 4,520,889 | A | 6/1985 | Abe et al. |
| 4,524,314 | A | 6/1985 | Walker |
| 4,613,804 | A | 9/1986 | Swenson |
| 4,791,570 | A | 12/1988 | Sherman et al. |
| 4,855,656 | A | 8/1989 | Saitoh et al. |
| 4,864,207 | A | 9/1989 | Miura et al. |
| 5,175,480 | A | 12/1992 | McKeefery et al. |
| 5,938,704 | A | 8/1999 | Torii |
| 6,289,269 | B1 | 9/2001 | Seiferling |

*Primary Examiner*—John A. Ricci
(74) *Attorney, Agent, or Firm*—Blakely, Sokoloff, Taylor & Zafman LLP

(57) ABSTRACT

Vehicle guidance and control systems that use the intensity of a field radiated from a source of radiation to define the track or lane for operation of the vehicles. The source of radiation used is a single source of radiation in the sense that vehicle position relative to the source of radiation is sensed by sensing intensity of the radiation at the vehicle, rather than the difference in field intensity sensed from two physically separated sources of radiation. Exemplary embodiments using a single magnetic field for navigational control are described, including a basic system for a single vehicle, a tethered system having steering and speed controls for creating a multiple vehicle racing environment, and a radio controlled system, also for creating a multiple vehicle racing environment and in the embodiment disclosed, also useable as a stand alone RC controlled vehicle.

20 Claims, 8 Drawing Sheets

20
127
VR4
28
28
Gear Case
Steer Motor
M2
32
32
M1
30
30

SINGLE WIRE AUTOMATICALLY NAVIGATED VEHICLE SYSTEMS AND METHODS FOR TOY APPLICATIONS

CROSS-REFERENCE TO RELATED APPLICATION

This application claims the benefit of U.S. Provisional Patent Application No. 60/405,932 filed on Aug. 26, 2002.

BACKGROUND OF THE INVENTION

1. Field of the Invention

The present invention relates to the field of toy vehicles.

2. Prior Art

Toy vehicle guidance systems of various types are well known in the prior art. Each of these guidance systems has certain advantages and disadvantages that characterize the system. Since the present invention is particularly (but not exclusively) suited to toy vehicle racing applications, certain prior art relating to toy vehicle racing applications will be discussed.

Electric racing sets commonly referred to a "slot vehicles" use plastic flat roadway with protruding embedded wires that are formed on the ends into electrical connectors. The plastic tracks are molded to have interlocking connectors to connect the plastic roadway together. The tracks are made with straight lengths and curved lengths which when connected together form the raceway. The vehicles pickup motive current from the track through brushes attached to the vehicles that contact the track wire. The vehicles are aligned on the track through a protruding pin on the vehicle that rides in a "slot" molded into the track.

The advantages of slot vehicle race sets include:

1. They are easy to use as there is only throttle control
2. No batteries are required The disadvantages of slot vehicle race sets include:

1. Embedded Wires connectors are fragile
2. Wire connections are unreliable
3. Plastic interlocking connectors are fragile
4. Vehicles pickup power from the embedded wires and this connection is unreliable
5. The roadway is expensive
6. The scale is typically limited due to roadway cost
7. Racing is limited to existing pathways with one vehicle in left lane and one vehicle in right lane
8. Pathway design is limited due to preformed straight and curved lengths
9. There is no steering control Also known are race vehicle sets known as hyper racers. Hyper racers use plastic U shaped track without embedded wires. Battery powered vehicles are placed in the U channels for racing. The vehicles fit completely inside the U channel. Vehicles are speed controlled through a radio link or the vehicles have no speed control at all and travel at a constant rate. The vehicles are centered in the U track through small idler wheels that protrude out the sides of the vehicle.

The advantages of hyper racers include:

1. Ease of use as there is no steering control
2. No embedded track wires are used Disadvantages of hyper racers include:

1. Use rollers on side of vehicle to navigate through track
2. Racing is limited to existing pathways
3. Racing control is limited to speed control only through Radio link 4. The roadway is expensive
5. The scale is typically limited due to roadway cost
6. There is no steering
7. The pathway design is limited due to preformed straight and curved lengths Also well known are radio controlled vehicles, which use no track at all. The vehicles are battery powered and are typically speed and steering controllable through a radio link. The absence of a track and the use of the radio link for control gives radio controlled toy vehicles a degree of flexibility not found in other toy vehicle navigation systems. As a navigation system for race vehicle sets however, pure radio control of all functions is less than optimum.

The advantages of radio control in general include:

1. There is no track required
2. There are no wires required
3. Radio control allows free form play without tracks The disadvantages of complete radio control in race vehicle sets include:

1. Racing is difficult, as radio control requires great skill
2. Racing in a confined space is difficult as control skill goes up as track scale goes down Two wire navigation system are also known, as in the earlier invention of the present inventor disclosed in U.S. Pat. No. 5,175,480. This early toy vehicle navigation system used flat flexible plastic roadway formed into curved and straight lengths. The roadway did not have "slots" or 'U Channels" to position the vehicles on the roadway. The flat plastic roadway segments allowed two wires to be inserted into the sides of the roadway. The wires were energized with an alternating half cycle AC current, one half cycle of current on the inside wire of the track followed by an opposite polarity half cycle current on the outside wire of the track. The vehicle sensed the respective magnetic field of each wire through a coil placed on the centerline of the vehicle in front of the front wheels. The location of the vehicle between the two wires was determined by comparing the half cycle energy picked up from each wire by the coil in the vehicle. The steering system of the vehicle was responsive to the sensed position of the vehicle on the track. Lane position and vehicle speed were responsive to modulation of the current in the two wires.

The advantages of this two wire system for toy race vehicle sets include:

1. It allowed speed control and lane changing between the wires of the track
2. It provided good racing environment as vehicles traveled along a predetermined pathway The disadvantages of this two wire system for toy race vehicle sets include:

1. It required plastic track to accurately separate wires a predetermined distance
2. The plastic track is expensive
3. It used single turn wire track loops which generated a very small magnetic field
4. The weak magnetic field caused noise immunity problems
5. The pathway design is limited due to preformed straight and curved lengths It would be desirable to provide a toy race vehicle set having at least some of the following features, advances and advantages:

1. Eliminate the requirement of a track, such as the plastic tracks on which vehicle racing is confined in many race vehicle sets 2. Eliminate the requirement of embedded wires in a track, such as a plastic track
3. Provide guidance control for lane position
4. Allow lane changing
5. Allow multiple vehicles on the track at same time
6. Allow for a track racing environment in free form RC control
7. Allow for infinitely variable track configurations
8. Provide a magnetic control field with a single wire or single bundle of wires

BRIEF SUMMARY OF THE INVENTION

Vehicle guidance and control systems that use the intensity of a field radiated from a source of radiation to define the track or lane for operation of the vehicles are disclosed. The source of radiation used is a single source of radiation in the sense that vehicle position relative to the source of radiation is sensed by sensing intensity of the radiation at the vehicle, rather than the difference in field intensity sensed from two physically separated sources of radiation. Exemplary embodiments using a single magnetic field for navigational control are described, including a basic system for a single vehicle, a tethered system having steering and speed controls for creating a multiple vehicle racing environment, and a radio controlled system, also for creating a multiple vehicle racing environment and in the embodiment disclosed, also useable as a stand alone RC controlled vehicle.

DETAILED DESCRIPTION OF THE PREFERRED EMBODIMENTS

Figure 1:
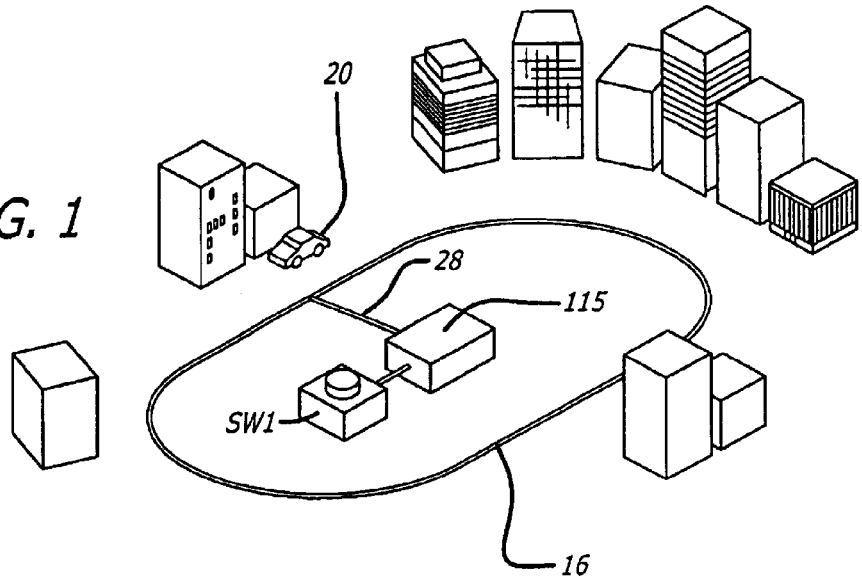
FIG. 1 is a schematic illustration of a first implementation of the present invention.

The present invention uses the intensity of a field radiated from a source of radiation to define the track or lane for operation of the vehicles. The source of radiation used is a single source of radiation in the sense that vehicle position relative to the source of radiation is sensed by sensing intensity of the radiation at the vehicle, rather than the difference in field intensity sensed from two physically separated sources of radiation. Disclosed herein, among other embodiments, are specific exemplary single wire, automatically navigated vehicle systems for toy applications that, depending on how the systems are implemented, will provide some or all of the desirable features, advances and advantages previously set forth. In accordance with the systems and methods of the exemplary preferred embodiments of the present invention, a track controller provides AC current, in a preferred embodiment of approximately 3 KHz to 30 KHz, to a conductive loop placed on (it could be somewhat above or below) the surface on which the toy vehicle is to be operated. The loop may be a single turn loop, or a multi-turn loop, as desired. The audio frequency current carried by the conductive wires creates a magnetic pathway that vehicles will travel along. The conductive wires may be, by way of example, 1 to eight conductors forming a single coil, as the more conductors in the wire pathway, the higher the magnetic field that is generated for a given current. Navigational control is provided to the vehicle by sensing the strength of the magnetic field generated by the track wire through a coil that is placed preferably along the centerline of the vehicle and preferably in front of the front wheels.

The vehicle can determine distance from the wire path by sensing the magnetic field strength. A control system in the vehicle controls the steering system of the vehicle responsive to the magnetic field strength. A weaker magnetic field generally means the vehicle is farther away from the track wire and a stronger magnetic field generally means the vehicle is closer to the track wire. The vehicle can be positioned at a commanded distance from the wire by causing the vehicle to seek a particular magnetic signal strength, with the control system on the vehicle providing stability in seeking and maintaining the vehicle at the commanded magnetic signal strength and thus the commanded distance from the wire. Speed control can be communicated to the vehicle such as by frequency modulating the current of the track wire or by radio control. Vehicle lane position can be communicated to the vehicle such as by varying the current in the track wire or by radio control.

In implementations wherein speed control is communicated to the vehicle such as by frequency modulating the current of the track wire and/or vehicle lane position is communicated to the vehicle such as by varying the current in the track, multiple vehicles can be controlled by assigning each vehicle a responsive frequency, such as; vehicle 1 can be responsive to the frequency range of 7 kHz to 9 kHz, vehicle 2 can be responsive to 12 kHz to 15 kHz and so on.

In the embodiments disclosed herein, distance of a vehicle from the wire loop is determined by the amplitude of the AC magnetic field. Consequently, a vehicle can be operated on either side of the wire loop. However, unless a switch is provided on a vehicle to reverse the polarity of the steering control on the vehicle (which can be easily done), the vehicle may only be stably operated in one direction on one side of the wire loop, and in the opposite direction on the other side of the wire loop.

Generally, in a toy race vehicle set, the vehicles will be operated on only one side of the wire loop and in one direction, particularly outside the wire loop for convenience and to maximize the length of the (physically nonexistent) track, though these choices of operation are discretionary and not a limitation of the invention. Further, while crossing over the wire loop to continue racing in the same direction would involve a complexity in stability which could be achieved but is not contemplated by the preferred embodiments, a bridge with guide rails and having a "U" shape so as to both cross over the wire loop and reverse the vehicle direction could be used to guide vehicles in a lane aligned with the bridge entrance to deposit the vehicle in the same lane on the opposite side of the wire loop and going in the opposite direction to further enhance the racing experience and length of the "track" without lengthening the wire loop.

As a further variation on the implementations that provide for lane control, vehicles could be operated in opposite directions on the same side of the wire loop by reversing the polarity of the vehicle stability control onboard some of the vehicles to provide a conventional two lane roadway type of play or race environment.

While many other embodiments are contemplated, some of which will be mentioned, there are three discrete design implementations of the invention described in detail herein, specifically:

1. An implementation wherein a track controller, when on, provides only a steady navigational current to the track wire. In this implementation, a vehicle will travel around the track wire at a predetermined distance from the wire. A presence or absence of track signal will make the vehicle start and stop, respectively. This implementation is low in both cost and capability, but may be ideal such as for a preschool toy that may start and stop at various stations around the track wire.

2. An implementation wherein a track controller provides navigational current with varying amplitudes for lane position and varying frequency for speed control. Multiple vehicles may be controlled in this version by assigning each vehicle a track frequency range that a respective vehicle will respond to; for instance, vehicle 1 can be responsive to the frequency range of 10 kHz to 15 kHz, vehicle 2 can be responsive to 20 kHz to 25 kHz and so on. Controls are hard wired to the track controller so that the operator can control speed and lane position of the vehicle.

3. An implementation wherein a track controller provides steady navigational current to the track wire, with lane position and speed controls being sent to the vehicle through a separate radio frequency controller. In a two vehicle implementation, the track controller could provide a steady navagational current at a single frequency. Vehicle one could be responsive to a radio frequency of 27 MHz and vehicle two could be responsive to a radio frequency of 49 MHz.

Each exemplary implementation will be described more accurately, particularly in reference to the detailed description of the schematics. In describing these implementations, certain elements, particularly the elements of the vehicle guidance and control systems, are identified by numerals in the form of XYZ, where X is a single digit indicating the exemplary implementation number and YZ is a double digit indicating a specific element in the implementation. In general, elements in the various implementations having the same YZ identifications may be of the same design and construction, regardless of the implementation in which they are used.

Implementation 1

First referring to FIG. 1, a schematic representation of a first exemplary implementation of the present invention may be seen. This implementation is comprised of a vehicle 20, a loop of wire 116, preferably a multi-turn loop of wire, powered by a power supply 115 having an on-off switch SW1, which may, by way of example, be on the top of the power supply 116, coupled thereto by wires as shown, or through some other simple communication link. If a multi-turn loop of wire is used, a multi-wire cable may be used with the wires connected in series, with the two ends of the series connections brought out such as by a conductor 28 for connection to the power supply 115. Individual plug together or fasten together cable sections are also contemplated. The vehicle 20 is battery powered, and the power supply 115 is preferably battery powered, though alternatively may be powered from a 110 AC source, such as from a plug mounted AC to low voltage AC/DC converter. Typically in this and the other embodiments to be disclosed in detail herein, the wire cable or equivalent, the vehicle and other components of the system will be given three dimensional graphic embellishments to appeal to the targeted age group, which embellishments are not part of the preferred embodiments of the present invention.

Figure 2:
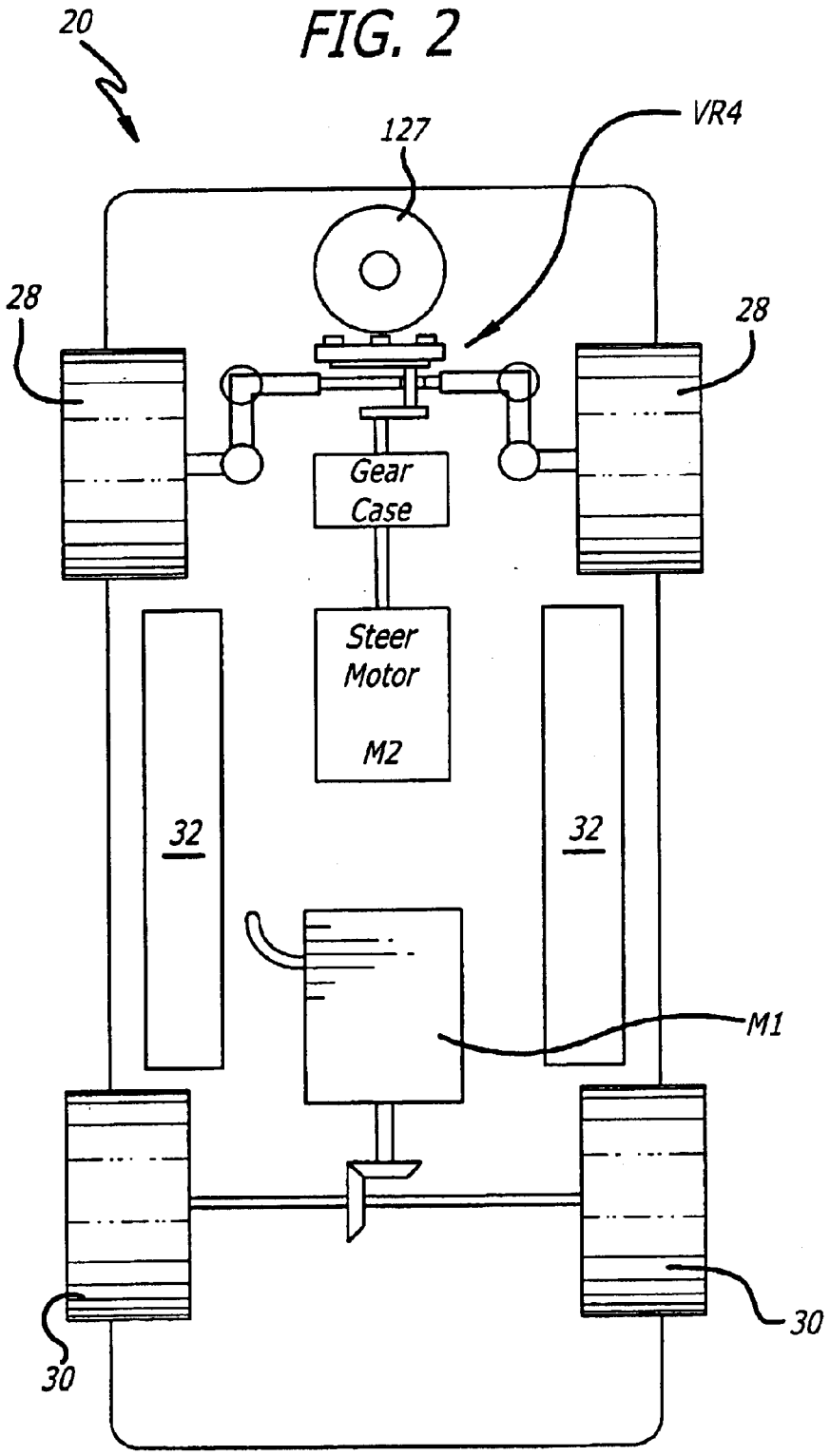
FIG. 2 is a schematic representation of the main components of the vehicle of FIG. 1.

Now referring to FIG. 2, a schematic illustration of the functional parts of the vehicle 20 of the embodiment of FIG. 1 may be seen. The exemplary vehicle may be a four-wheel vehicle having front wheels 28 and rear wheels 30. The vehicle may be powered by a battery 115 which powers the motor M1 and the steering mechanism comprised of a gear motor, or as an alternative, a linear motor 36, and feedback potentiometer VR4, the function of which will be subsequently described. Also mounted on the vehicle, preferably forward of the front wheels, is a pickup coil 127 sensing the magnetic field from the wire loop 116 of FIG. 1. The sensing coil may be a coil 127 of many turns around a ferrite core, such as a surface mount inductor. Also mounted aboard the vehicle is certain electronic circuitry that shall be described with reference to FIG. 3.

Figure 3A:
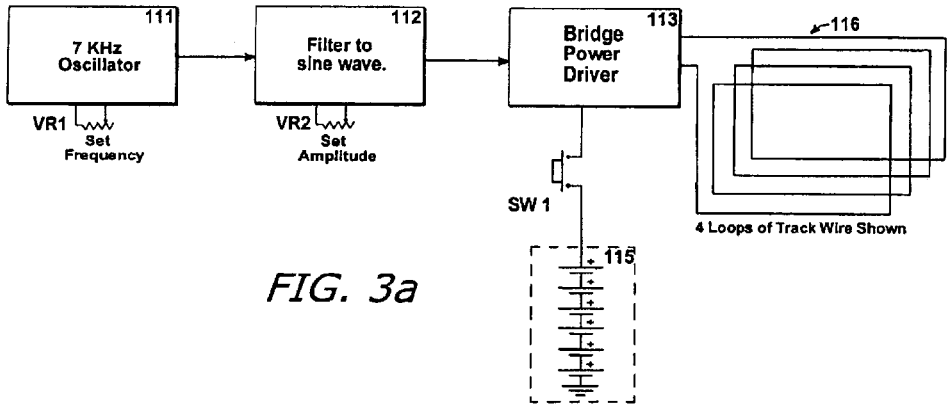
FIG. 3*a* is a block diagram of the track controller used with the implementation of FIG. 1.

Now referring to FIGS. 3*a* through 3*d*, block diagrams for powering and control of the vehicle 20 of FIGS. 1 and 2 may be seen. In FIG. 3*a*, the power supply 115 may be coupled through switch SW1 to drive the bridge power driver 113 providing an AC current of a fixed amplitude and frequency to the multi-turn loop of wire 116, schematically illustrated in rectangular form, though normally contemplated as a freeform smoothly curving loop of wire or at least of a regular geometric form with relatively large radius corners. Also coupled to the bridge power driver 113 is a oscillator 111, in this embodiment for example, a 7 KHz oscillator which drives a filter 112 to convert the square wave of the oscillator to a sine wave for EM1 noise suppression. While the switch SW1 is shown providing power to the bridge power driver, the same switch may also control power to the 7 KHz oscillator so that the entire power source is off when the switch is not depressed.

Figure 3B:
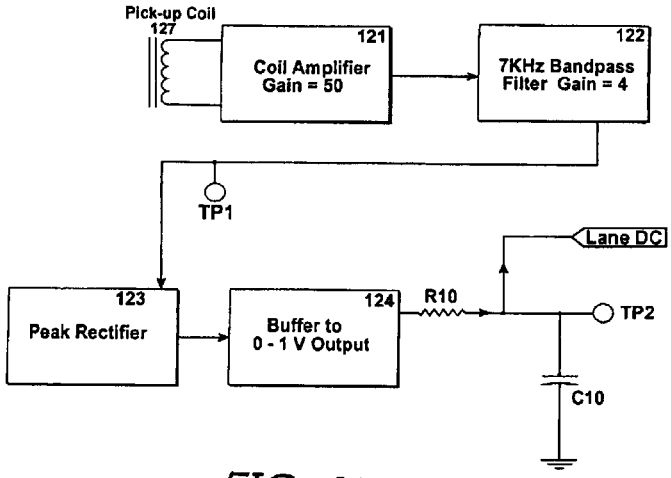
FIG. 3*b* is a block diagram of electronics on the vehicle of FIG. 1 for detecting vehicle position by sensing the strength of the magnetic field at the vehicle of FIG. 1.

As shown in FIG. 3*b*, on the vehicle itself, the pickup coil 127 provides a 7 KHz signal proportional to the strength of the 7 KHz magnetic field from coil 116 to a coil amplifier 121 having a substantial gain, such as a gain of 50. The pickup coil 127 of course will also sense other magnetic fields such as any 60 hz magnetic fields and harmonics thereof, which other frequencies will be filtered out by the bandpass filter 122, in the exemplary embodiment being described, a 7 KHz active filter having a gain of 4. The 7 KHz output of the bandpass filter 122 is peak detected by peak rectifier 123, buffered and scaled to a 0V to 1V output by block 124 and filtered somewhat by the combination of resistor R10 and capacitor C10 to provide a LANE DC signal proportional to the strength of the 7 KHz magnetic field sensed by the pickup coil 127.

Figure 3C:
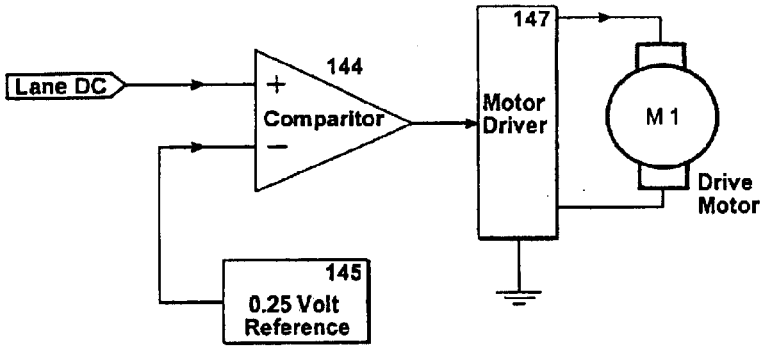
FIG. 3*c* is a block diagram of the drive motor control on the vehicle of FIG. 1.

Now referring to FIG. 3*c*, the motor control circuitry for the drive motor M1 may be seen. As shown therein, a comparator 144 provides an output to motor driver 147 which in turn will supply power to the drive motor M1 whenever the output of the comparator is high. The positive input to the comparator 144 is the LANE DC signal previously described, with the negative input to the comparator being in this embodiment a 0.25V reference. Accordingly, when switch SW1 is not depressed, the pickup coil 127 will not sense any 7 KHZ magnetic field and accordingly the LANE DC signal will be substantially zero volts. Accordingly, the negative input to comparator 144 will be greater than the positive input to the comparator, holding the output of the comparator low and the drive motor off. However whenever switch SW1 is depressed and the vehicle is physically positioned within a reasonable proximity of the loop of wire 116, the LANE DC signal will exceed the 0.25V reference, and accordingly the drive motor will be powered by the motor driver 147.

Figure 3D:
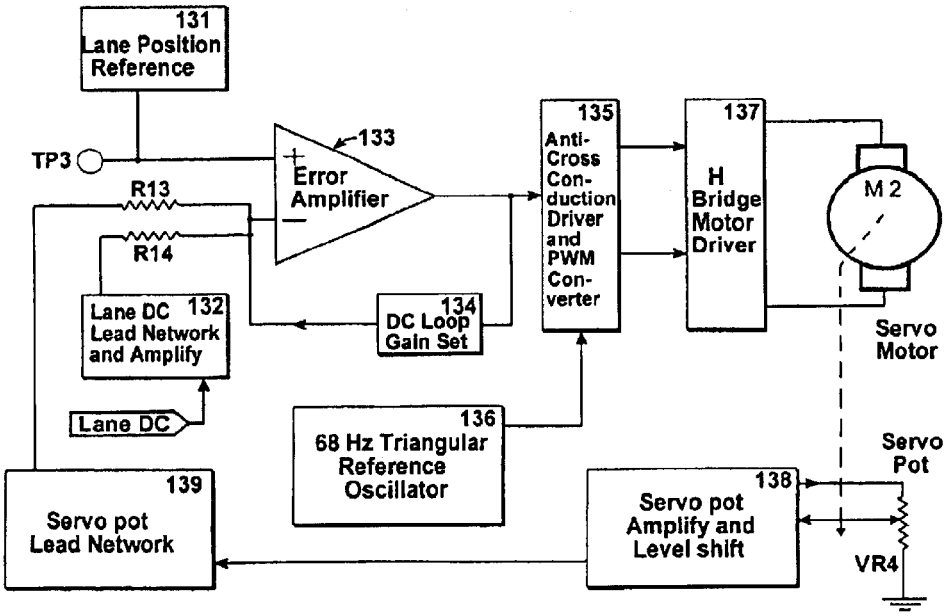
FIG. 3*d* is a block diagram of the steering control system on the vehicle of FIG. 1.

Now referring to FIG. 3*d*, the steering control for the vehicle may be seen. The feedback potentiometer or servo potentiometer VR4 (see also FIG. 2) provides a signal to the Servo Pot Amplify And Level Shift block 138, which provides a steering mechanism position signal to the Servo Pot Lead Network 139. The output of the Servo Pot Lead Network is applied as one of the inverting inputs to error amplifier 133 through resistor R13. Neglecting for the moment the signal also applied to the inverting input of the error amplifier and resistor R14, the output of the Servo Pot Lead Network 139 is compared with the Lane Position Reference signal from block 131 to provide an error amplifier output to the Anti-cross Conduction Driver and Pulse Width Modulation Converter 135. This converter drives the H Bridge Motor Driver 137 to drive the Servo Motor M2 controlling the physical position of the steering mechanism on the vehicle 20. This closed loop provides a relatively tight servo loop for the steering mechanism itself, the Servo Pot Lead Network 139 providing the required lead to assure good stability of this loop.

The LANE DC signal is also applied to the Lane DC Lead Network and Amplification Block 132 that also provides a signal to the inverting input of Error Amplifier 133 through Resistor R14. This input is part of a larger and much slower response control loop that includes the physical position of the vehicle relative to the loop of wire 116. The Lead Network in block 132 provides stability for the vehicle position relative to the wire loop 116. The Lead Network in block 132 provides stability for the vehicle position relative to the wire loop 116. In particular, the Lead Network causes the car to seek a position or lane relative to the wire loop 116 that provides a pickup coil output to the inverting input of error amplifier 133 equal to the Lane Position Reference signal of block 131 without overshoot, or at least without significant overshoot.

Oscillator 136 and Anti Cross Conduction Driver and Pulse Width Modulation Converter 135 remove the hysteresis in the steering system in a manner subsequently described in detail with respect to FIG. 7*c*

Implementation 2

Figure 4:
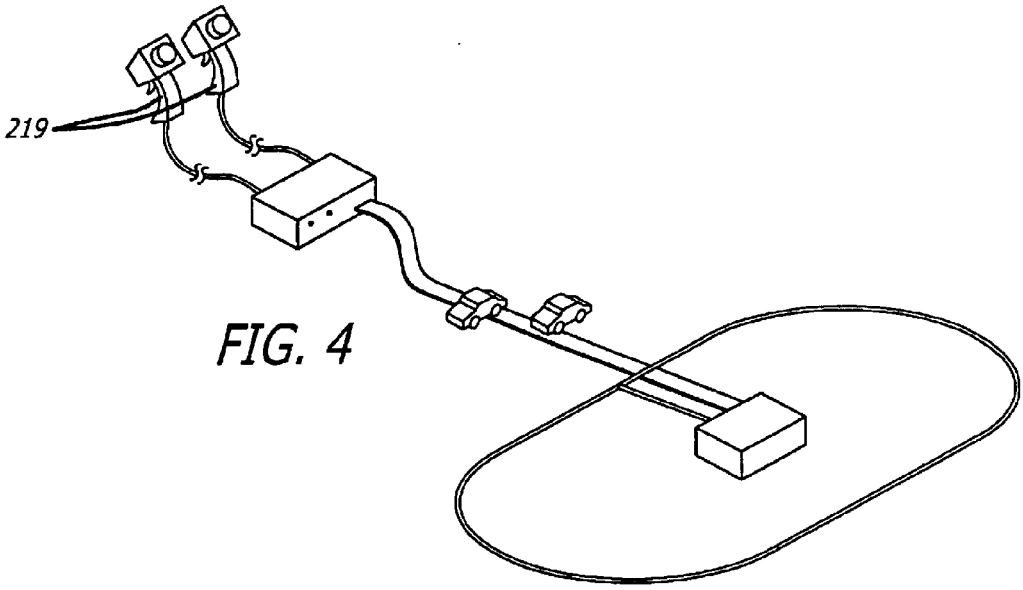
FIG. 4 is a schematic illustration of a second implementation of the present invention.

Now referring to FIG. 4, a second exemplary implementation of the present invention may be seen. This implementation provides substantial control over the vehicle, allowing one or more vehicles to be simultaneously used, such as in a race environment. Physically, this embodiment is similar to the embodiment of Implementation 1 with the exception that the on-off switch SW1 of the prior embodiment is eliminated in favor of manual vehicle controllers 219. Also the power supply (and vehicle controllers 219) are substantially more capable than the simple power on-off of the earlier embodiment.

In this implementation, the current in the track wire is modulated to carry the speed and steering information to multiple vehicles. Each vehicle has a frequency band that it responds to, which may be fixed or user selectable on the vehicle. The amplitude of the current within the assigned frequency band sets the distance from the wire that the vehicle travels. The actual frequency within that band sets the vehicle's speed. For example in a two vehicle system, the frequency bands could be allocated such that vehicle "A" would be responsive to the frequency range of 7.0 KHz to 9.0 KHz, and vehicle "B" would be responsive to the frequency range of 12 KHz to 15 KHz.

Figure 5A:
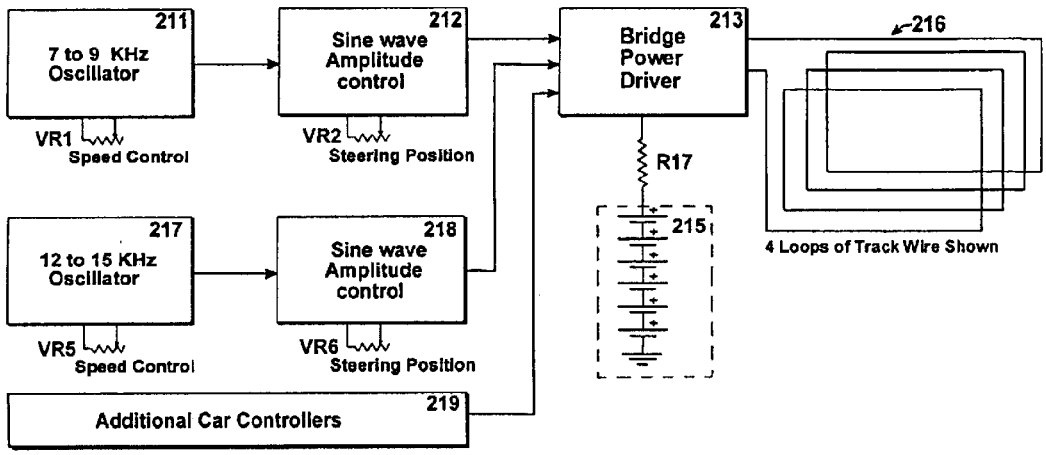
FIG. 5*a* is a block diagram of the track controller used with the implementation of FIG. 4.
Figure 5B:
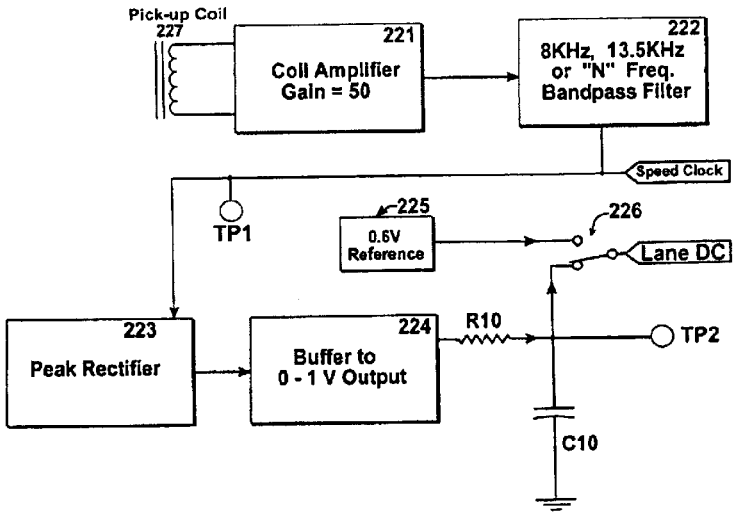
FIG. 5*b* is a block diagram of electronics on the vehicle of FIG. 4 for detecting vehicle position by sensing the strength of the magnetic field at the vehicle.

In the circuit block diagram of FIGS. 5*a* through 5*d*, more specifically FIG. 5*a*, the controllers and the loop of wire are powered by the power supply 215. The vehicle "A" hand controller is represented by a controllable oscillator 211 having a frequency range of 7 to 9 KHz for speed control, and a sine wave amplitude control 212 for steering (lane) control. The "B" vehicle hand controller is represented by a controllable oscillator 217 having a frequency range of 12 to 15 KHz for speed control, and a sine wave amplitude control 218 for steering control. The system can expand to further multiple vehicles by additional car controllers 219, each operating on its own assigned frequency range. For Vehicle "A" the 7.0 KHz could represent a stopped vehicle, the 9.0 KHz could be the maximum speed, with anything in between being directly proportional for infinite speed adjustment. Similarly the amplitude for the 7 to 9 KHz signal is adjusted proportionally from 100 ma to 400 ma to set an infinite number of lane positions. While the control in the embodiment shown is proportional control by way of potentiometers VR1, VR2, VR5 and VR6 controlled by knobs trigger controls, discrete steps in speed and/or lane position are also within the scope of the invention. However, a sine wave of reasonably quality should be used for the wire current so that unwanted radiated noise will pass FCC tests. Digital circuitry in the track driver module can be problematic since no earth ground is present and the track wire represents a very large antenna to RF signals.

Each vehicle senses the magnetic field within its assigned frequency range and corrects its position so that it always drives in an area of a predetermined fixed magnetic flux density. The lanes are distances from the wire all of the way around the track. In one example the center lane would be 12" from the track wire. As the user steers left, the vehicle will follow the wire as close as 5" away from the wire. As the user steers right, the vehicle would travel as far away as 19" from the track wire. This is approximately equal to the 4 to 1 range in the current in the respective frequency range (100 ma to 400 ma), with the vehicle seeking and traveling along the track closest to the wire loop for the lower current value to find the predetermined flux density. In this example the vehicle is traveling counter clockwise around the track. To make the same vehicle stably travel around the track in the opposite direction, the vehicle would need to be operated on the other side of the track, or the polarity of the steering system control signal on the vehicle would need to be reversed. In any event, the steering system of FIG. 5*b* comprising elements 227, 221, 223, 224, 225 R10 and C10 are the same and function the same as elements 127, 121,

123, 124, 125, R10 and C10 of FIG. 3*b*. Bandpass filter 222 has a similar function as the bandpass filter 122 in FIG. 3*b*, though has the frequency pass band associated with the respective vehicle.

In a prototype in accordance with this implementation, an 8 conductor phone cord of about 20 feet long was used as the track wire. The 8 turns required only 400 ma to get 3 ampere turns of magnetizing force. A single turn could also be used, but a 3 amp signal would be needed for the same magnetizing force. If battery power is used, the battery life would be severely reduced if a 3A level was used. This is to be compared to the race car set of U.S. Pat. No. 5,175,480. In that system, there was only one effective turn, and at 0.5 amperes, only 0.5 ampere turns. That system required a higher level of sophistication to isolate motor noise and amplify the much weaker signal in the vehicle. The higher flux density of the preferred embodiments of the present invention makes the present system more robust and easier to manufacture.

The track controller 213 may be just an amplifier with a mixer front end that can take multiple hand controllers, amplify the signals up to higher power and drive the track wire. Each frequency band may put about 1.5 watts of power into the wire. The track controller may be powered by 6 "C" cells. In this and other embodiments, the track controller and wire loop 216 usually reside in the center, with the vehicles traveling around the outside perimeter of the wire loop, though this is not a limitation of the invention. In this embodiment, a flat strip of plastic that the vehicles can run over may be provided to connect the track controller to an outside module that the hand controllers plug into. As an alternative, the track controller may be adjacent the outside perimeter of the loop of wire, with the vehicles traveling relative to the wire on the inside of the loop. This would eliminate the crossover plastic strip, but would require more track wire for the same length of vehicle "track".

The magnetic field from the track wire 216 is picked up by coil 227 and amplified by the coil amplifier 221. In this implementation, the amplifier has a more complex and crucial role than in the first implementation. Specifically the amplifier must receive and amplify the signals in each frequency band with the same gain across the respective frequency band. If this is not the case, a change in the throttle setting (frequency) will cause an apparent change in the magnetic field strength, thereby effecting the lane position. Each amplifier must also reject all other frequencies by the use of the Bandpass Filter 222, especially the other bands transmitted by the track wire for control of other vehicles. The Coil Amplifier 221 takes the amplified signal of about 2V peak to peak, which is converted to a DC level of zero to 1V in blocks 223 and 224 responsive to how far away from the track wire the vehicle is. For one prototype system, the LANE DC was set to 0.6 VDC, the physical lane position being proportional to the amplitude of the current in the wire loop 216 in the frequency range assigned to the particular vehicle.

The rest of the steering system (FIG. 5*d*) is the same as described with respect to FIG. 3*d*. However block 231 providing a reference voltage is labeled Steer Reference Set rather than Lane Position Reference of FIG. 3*d*, as the output of the Lane Position Reference 131 determines the lane position the vehicle will stay in, whereas the output of the Steer Reference Set 231 merely determines the magnetic field strength the vehicle will seek as the lane position is varied by a user by manual control of the magnitude of the current in the loop of wire 216 within the respective frequency range.

Figure 5C:
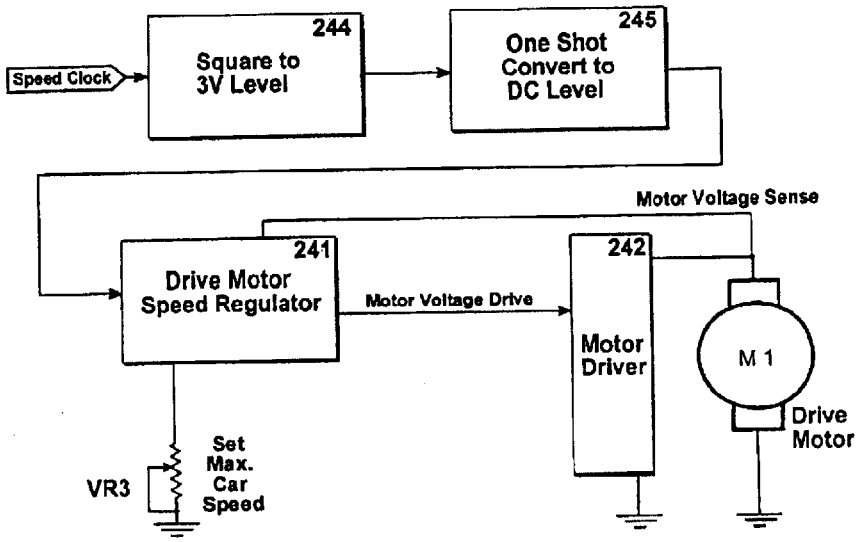
FIG. 5*c* is a block diagram of the drive motor control on the vehicle of FIG. 4.
Figure 5D:
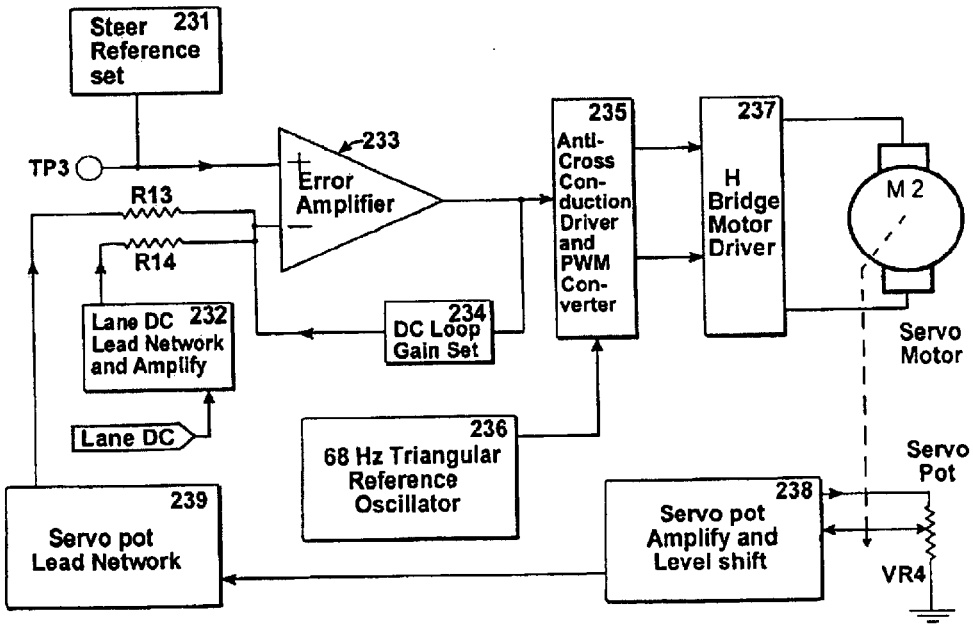
FIG. 5*d* is a block diagram of the steering control system on the vehicle of FIG. 4.

FIG. 5*c* is a diagram for the frequency to motor drive section of this implementation. This section takes an AC signal SPEED CLOCK of FIG. 5*b* and uses the frequency component only to derive the vehicle speed. First the signal is squared to a 3V reference level by block 244. Then a one shot 245 takes all leading edges and converts them to a 20 $\mu$s pulse. As the frequency increases, the duty cycle of this signal increases as the 20 $\mu$s becomes more of the cycle. This is then filtered to a DC level in block 245 and sent to the Drive Motor Speed Regulator of block 241. For the "A" vehicle, the 7 to 9 KHz frequency range is converted to a voltage that will be the zero to full speed range. This voltage is buffered by the block 242 to drive the motor M1. The motor's voltage is measured by block 241 and is regulated to regulate the vehicle's speed over the entire range of load and battery voltage. Without this feature, in a race environment, the vehicle with the freshest batteries could always win. Driver skill is still required to win, but the maximum speed is limited by potentiometer adjustment VR3 to maintain vehicle stability.

Implementation 3

Figure 6:
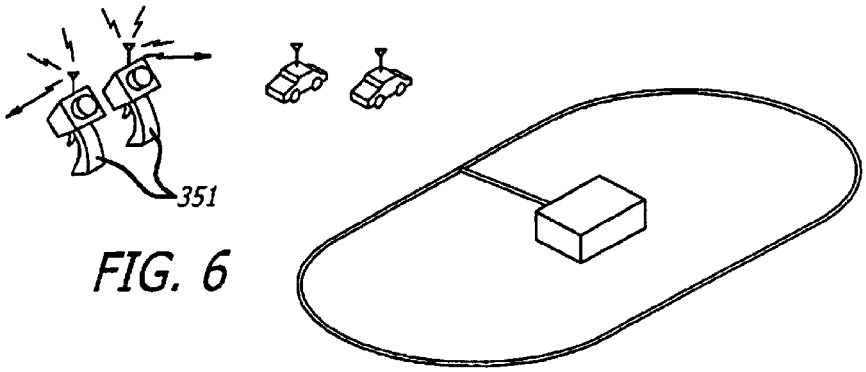
FIG. 6 is a schematic illustration of a third implementation of the present invention.

Now referring to FIG. 6, a third exemplary implementation of the present invention may be seen. This implementation is similar to implementation 2, though uses one or more hand held RF transmitters 351 for communicating vehicle speed and steering control signals to RF receiver(s) 361 in a respective one or more vehicles. Also in this implementation, neither the lane selection or vehicle speed is infinitely variable, though this is merely a design choice and not a limitation of the invention.

In this implementation, the track wire emits a constant frequency, constant amplitude sinusoidal magnetic field in the 2 Khz to 40 Khz range. The car senses the magnetic field strength and corrects its position so that it always drives in an area of prescribed magnetic flux density. As shown in FIG. 7*c*, the operator has an RF transmitter 351 that can control the car's speed and can select one of several lanes for the car to drive in. These "lanes" are distances from the wire all of the way around the track. In one example the center lane would be 12" from the track wire. As the operator steers left the car will follow the wire at a distance of 5" away from it. As the operator steers right, the car will travel at 19" from the track wire. In this example the car is traveling counter clockwise around the track. Note that this system can support multiple cars, in fact as may cars as there are frequencies available for the RF transmitter and receiver.

The controls for the RF Transmitter 351 are comprised of a trigger control and a steering knob control. Both of these controls have default conditions, namely drive motor off for the forward/reverse control and center lane selected for the right/left control. The RF Receiver 361 of course will receive the selections from the RF Transmitter to control the Radio Steer Reference 331, the Drive Motor Speed Regulator 341 and the H Bridge Motor Driver 342. In particular, if forward is selected, the Drive Motor Speed Regulator 341 will provide the motor voltage drive to the H Bridge Motor Driver 342 to turn on the motor M1. Resistor R15 is provided to monitor the forward motor current, with Motor Current Amplifier 343 providing a measure thereof to the Drive Motor Speed Regulator 341. Preferably the maximum car speed is carefully set by prior adjustment of potentiometer VR3 with the Drive Motor Speed Regulator 341 providing relatively good regulation of the motor speed to provide fairly based competition between multiple cars. If no steering control input is provided, only the forward drive signal, the Radio Steer Reference 331 will provide an output to the Error Amplifier 333 to cause the vehicle to proceed down the center track, in a preferred embodiment approximately 12" from the loop of wire. In that regard, steering control servo loops in the radio controlled embodiment of FIG. 7*c* comprising Error Amplifier 333 and Anti Cross Conduction Driver and Pulse Width Modulator Converter 335, DC Loop Gain Set 334, H Bridge Motor Driver 337, Turbo Motor M2, Servo Potentiometer VR4, Servo Pot Amplify and Level Shift Block 338, Servo Pot Lead Network 339, Resistors R13 and R14, the Lane DC Network and Amplify 332 and the 68 Hz Triangular Reference Oscillator 336 may be identical to the corresponding elements shown in FIGS. 5*d* and 3*d*.

A steer left signal provided to the RF Transmitter 351 will cause the Radio Steer Reference 331 to output a higher DC level causing the vehicle to now seek a lane having a higher magnetic field strength such as a lane approximately 5" from the loop of wire. Similarly a steer right signal received by the RF Signal 361 will cause the Radio Steer Reference 331 to output a lower voltage signal causing the vehicle to seek a lane having a lower magnetic flux density typically on the order of 19" from the loop of wire. Assuming a counter clockwise movement of the vehicles around the wire, the default position then is the center lane, the steer right position is the right hand lane and the steer left position is the left hand lane, the car of course stably seeking the next commanded lane during any commanded lane change.

Figure 7A:
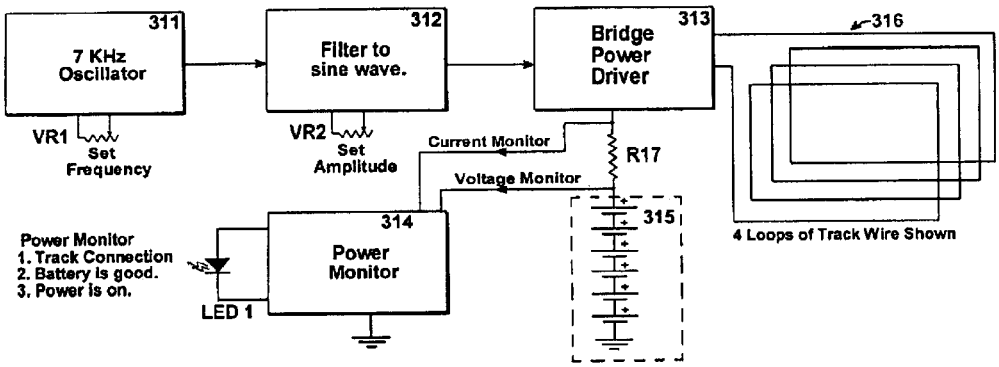
FIG. 7*a* is a block diagram of the track controller used with the implementation of FIG. 6.
Figure 7B:
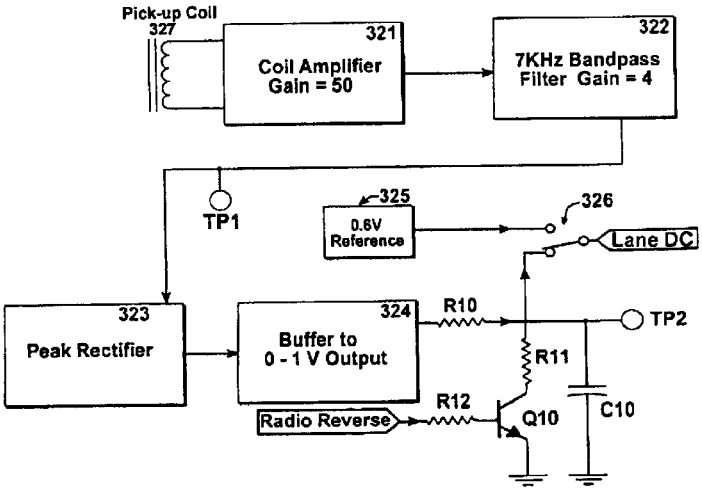
FIG. 7*b* is a block diagram of electronics on the vehicle of FIG. 6 for detecting vehicle position by sensing the strength of the magnetic field at the vehicle.
Figure 7C:
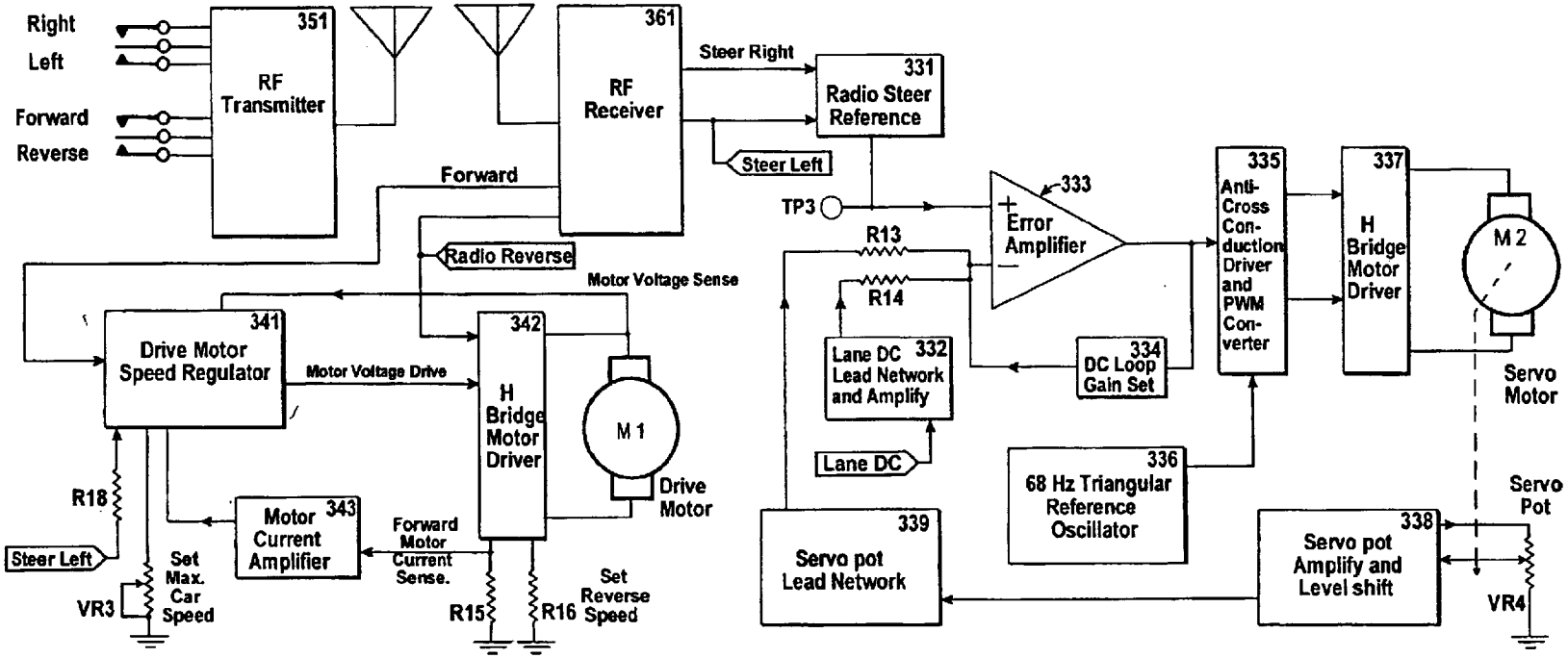
FIG. 7*c* is a block diagram of the drive motor control and steering control system on the vehicle of FIG. 6.

As may be noted in FIG. 7*c*, the RF Receiver 361 also provides a steer left signal that is provided through Resistor R18 to the Drive Motor Speed Regulator. This causes the output of the Drive Motor Speed Regulator whenever a steer left signal is received to reduce the motor voltage drive somewhat to reduce the speed of the vehicle. In particular, since the inside lane is shorter than the center lane, the vehicle in the left lane would always have the advantage over the vehicle in the center lane. Accordingly, this feature slows the vehicle in the left lane in comparison to the vehicle in the center lane to take away the lane advantage in the racing environment. While the embodiment shown does not include the same feature to speed up the vehicles in the right hand lane, clearly, such a provision could easily be added if desired.

With respect to the reverse capability, when a reverse signal is transmitted from the RF Transmitter 351 to the RF Receiver 361, a radio reverse signal is provided to the H Bridge Motor Driver 342 to reverse the direction of the vehicle drive to cause the vehicle to backup. Resistor R16 is used to set the reverse speed for the vehicle, which typically will be set considerably slower than the forward speed. The radio reverse signal is also provided through Resistor R12 (FIG. 7*b*) to Transistor Q10, turning the same on to pull the LANE DC voltage down. This causes the vehicle to backup in a different trajectory than in its forward motion, allowing the vehicle to back away from an obstacle without merely going back and forth over the same path without getting away from the obstacle.

In this implementation, the Bridge Power Driver 313 should drive a current into the wire that is constant over time, temperature, and battery life. Any variation in this current will cause the lane positions to move proportionally. The end product may have fixed obstacles that the cars must miss, so these lanes must be defined well. Also, the track wires 316, whether single, 4 or 8 strands, should be housed in a barrier or tube that will allow the wire to lay flat and have a smooth curving profile when positioned into any patterns by the persons playing with the set, as rippling or kinkiness in the wire will be followed by the car and cause it to visibly wiggle and look unstable.

Also shown in FIG. 7*b* is the Switch 326 which changes the LANE DC signal from a signal responsive to the sense magnetic field intensity to a fixed 0.6 volt reference. Without a steer right or steer left signal, the Radio Steer Reference 331 output is 0.6 volts, and the vehicle will be steering straight ahead. A steer left or steer right signal received by the RF Signal 361 will cause the steering system to steer left or steer right, with the steering system going to the limit in either direction because of the absence of feedback of a sensed magnetic field intensity. Thus, Switch 326 allows the vehicle to be used as a regular RC vehicle with forward and reverse and right and left being controllable by the controls on the RF Transmitter 351 without powered wire loop 316, etc. of FIG. 7*a*.

The radio transmitter and receiver in this implementation may be standard off the shelf technology. A prototype used what is called a seven function remote. The transmitter 351 has forward, forward right and forward left, reverse, reverse left, reverse right and stop. The 3 forward and the stop are most frequently used, but reverse is included. When in tracking mode, the reverse also has a hard wire programmed right turn in the car (see Radio Reverse, FIGS. 7*b* and 7*c*) so the when it backs up it does so in a straight line until it passes the center "lane". Without this feature the car would just go back and forth on the same 'j' line to no avail.

When the Radio Receiver 361 gets a turn left command, this is sent to the servo controller and the 0.6 Vdc at the Radio Steer Reference 331 that is normal for the center lane is boosted to 1.0 VDC. Now the system steers until if finds a path that has a flux density that gives 1.0 VDC from the Coil Amplifier 321, or about 5" from the Wire 316 in this prototype. Similarly, when the Radio Receiver 361 gets a turn right command, this is sent to the servo controller and the 0.6 Vdc from the Radio Steer Reference 331 that is normal for the center lane is reduced to 0.3 VDC. Now the system steers until if finds a path that has a flux density that gives 0.3 VDC from the Coil Amplifier 321, or about 19" from the Wire 316 in this embodiment.

In this implementation, the Radio Receiver 361 sends commands to the motor speed control circuit (FIG. 7*c*) for the normal forward, reverse, and stop. Additionally, as previously mentioned, in forward mode the motor's current is measured by resistor R15 and the voltage to the motor is regulated by the Drive Motor Speed Regulator 341 in such a way to regulate the car's speed over the entire range of load and battery voltage. This can be important, as without this feature, the car with the freshest batteries would always win. Driver skill is still required to win, but the maximum speed is limited to maintain car stability. This of course relates to multiple car racing implementations, and could apply to implementations such as the second implementation described herein. The single car product does need this feature to maximize car speed over the battery voltage range, though control is not required to be as precise either.

Prototypes of this third implementation used a dual path servo controller. The primary path is that the steering servo moves to seek equilibrium with the Lane DC signal that monitors the track wire flux density. The secondary and also critical path is the feedback from a potentiometer VR4 on the steering servo that represents front wheel steering position. This pot also comes back as negative feedback to the servo system. The net result of these two paths is that as the car is moved ½ inch off the prescribed course, the front wheels will turn to a proportional 10 degrees, at 1 inch off the front wheels will turn 20 degrees. In this way, steering angle is proportional to lane position error. This not only gives the car stability, but it also has another important effect. The flux density in an outside turn is lower because the field is spread over a larger area per wire length. This would cause the car to travel closer to the wire to compensate. But the dual path servo method means that when the wheels are in a turn at 20 degrees, then the car is one inch further away from the wire in a turn. These two effects cancel at a certain turn radius for a given set of circuit values. This design feature allows the car to travel around the entire circuit of inside and outside turns at a given distance from the wire even though the actual flux density is not that constant between turns and straight portions of the "track". The gain of each path is set by resistors R13 and R14.

Another feature of the servo may be the way the power is driven to the motor. Small DC motors, especially at low voltage, will not move until several volts are applied to them. In addition, a low cost gear reduction system will have some gear lash. Both of these add to create a hysteresis that makes it hard to make small position changes. Also the response time to a step change is sluggish because it has to cross this hysteresis gap. To resolve this, the prototypes use a four quadrant pulse width modulation (PWM) motor driver 335, 336, 337. A constant 50% square wave is sent to the motor when no movement is required. To move right a little, the drive may be changed to 45/55%, and to move left a little more, the drive may be changed to 60/40%. This overcomes the motor voltage hysteresis. A switching frequency that is about 4 times the resonant frequency of the steering servo system may be used, which in the prototypes, was about 64 Hz (Oscillator 336). This means that the servo motor vibrates back and forth just enough to barely move the front wheels. This absorbs all of the gear lash, providing a low cost servo capable of high speed and accuracy. In the actual application, to reduce battery power, the 50/50 condition above is a positive pulse of 10% then a delay and a negative pulse of 10% and a delay, so a little right is actually 5% and then 15%. Further right is 0% and 20%, still further right is 0% and 50%, and on up to 0% and 100%.

There has been described herein three specific implementations of the present invention, which implementations are exemplary only and not limiting of the present invention. In that regard, various aspects of each implementation may be used in other implementations to expand or reduce the features thereof. Further, still other implementations will be obvious to those skilled in the art.

By way of example, signals supplied to the coil of wire such as in the second implementation may be FM or AM modulated so that a serial data stream is encoded that contains the vehicle speed and lane position information for multiple cars. In such an embodiment, the hand controllers could be tethered as in the second implementation as shown in FIG. 4, though could also be radio controlled if desired. Still other types of communication links could be used if desired, such as by way of example, infrared communication links as are well known in the electronics art. Further, while the implementations disclosed herein use a low frequency current in a coil of wire to generate a magnetic field picked up by a coil on each vehicle to control vehicle lane position, a radiated electrical field can be used instead, with the vehicle receiving the signal and using its relative strength to navigate around a transmitting antenna of any shape. Similarly, the field generated for use by the vehicles for position control and/or speed control could be an acoustic field, such as might be accomplished by a track tube or other means radiating an acoustic signal perimeter in which an acoustic signal of any frequency is induced. In such a system, the vehicle would receive that signal with an acoustic microphone and use its relative strength to navigate around the perimeter of the loop that is transmitting the acoustic signal. While such a system could be in the audible range, preferably somewhat higher frequencies would be used, such as 20 Khz to 50 Khz, for example.

Still other radiation may be used to create a field whose strength is sensed on the vehicles, such as by way of example, visible or infrared light, preferably modulated at a fixed frequency, or variable frequencies to control lane position and/or vehicle speed, with its intensity sensed in a manner to eliminate sensitivity to background light of other frequencies. Also while radiation generated by a loop of preferably readily reconfigurable shape, such as magnetic, electrical or otherwise is preferred, the field created may be generated by one or more point sources (or near point sources) such as one or more acoustic sources, light sources, electric field sources, etc. In that regard, a single source such as an acoustic source or light source would create a circular track if the source were omnidirectional, though such sources could readily be distorted by unsymmetrical baffles, filters and the like, or by use of multiple directional sources that each primarily control the intensity of the field over a limited section or arc of the track.

Thus various changes in form and detail may be made in the present invention without departing from the spirit and scope of the invention as defined by the full scope of the following claims.

What is claimed is:

1. A toy vehicle automatic navigation system comprising:

a single wire loop having one or more turns of wire;

a source of alternating electric current coupled to the wire loop, the wire loop providing an alternating magnetic field in response to the alternating electric current; and, a toy vehicle comprising;

a propulsion system for propelling the toy vehicle along a surface;

a pickup coil oriented on the vehicle to provide a pickup coil signal responsive to the strength of the alternating magnetic field through the pickup coil; and, a toy vehicle steering system responsive to the pickup coil signal to steer the toy vehicle along a lane separated from the wire loop by a distance providing a pickup coil signal responsive to a steering control signal.

2. The toy vehicle of claim 1 wherein the steering control signal is a fixed signal.

3. The toy vehicle of claim 1 further comprised of a manually operable switch, the switch being coupled to the source of alternating electric current to control the presence and absence of the alternating electric current in the wire loop, the propulsion system being responsive to the pickup coil signal to propel the toy vehicle when the pickup coil signal is present.

4. The toy vehicle of claim 1 wherein the steering control signal is manually controllable.

5. The toy vehicle of claim 4 wherein the steering control signal is a proportional control.

6. The toy vehicle of claim 4 wherein the manual control is a manual control for selecting between predetermined steering control signals, thereby providing for a multiplicity of lanes.

7. The toy vehicle of claim 4 wherein the steering control signal is communicated from a manual control to the toy vehicle by an RF link.

8. The toy vehicle of claim 7 further comprised of a mode switch on the toy vehicle switchable between steering using the automatic steering system responsive to the coil signal or steering using the steering control signal to steer front wheels of the toy vehicle directly while ignoring the coil signal.

9. The toy vehicle of claim 4 wherein the steering control signal is communicated from a manual control to the toy vehicle through conductors to the source of alternating electric current, the manual control controlling the magnitude of the alternating current.

10. The toy vehicle of claim 9 wherein the manual control is a proportional control.

11. The toy vehicle of claim 9 wherein the manual control is a manual control for selecting between predetermined magnitudes of the alternating current.

12. The toy vehicle of claim 4 wherein the speed of the propulsion system is responsive to a speed control signal, the manual control including a manual speed control providing the speed control signal, and wherein the speed control signal is communicated from the manual control to the toy vehicle by an RF link.

13. The toy vehicle of claim 12 wherein the manual speed control is a manual speed control for selecting between predetermined speed control signals.

14. The toy vehicle of claim 4 wherein the speed of the propulsion system is responsive to a speed control signal, the speed control signal being communicated to the toy vehicle by controlling the frequency of the alternating current.

15. The toy vehicle of claim 14 wherein the manual speed control is a proportional control.

16. The toy vehicle of claim 14 wherein the manual speed control is a manual speed control for selecting between predetermined steering signals.

17. A toy vehicle navigation system comprising:

a single wire loop having one or more turns of wire;

a source of alternating electric current coupled to the wire loop, the wire loop providing an alternating magnetic field in response to the alternating electric current;

a plurality of toy vehicle manual controls coupled to the source of alternating current, each manual control having a manual steering control controlling the amplitude of the alternating current within a unique frequency band for the respective toy vehicle, and a manual speed control controlling the frequency of the alternating current within the unique frequency band for the respective toy vehicle;

the plurality of toy vehicles each comprising;

a pickup coil oriented on the vehicle to generate a coil signal responsive to the strength of the alternating magnetic field through the pickup coil;

a propulsion system for propelling the toy vehicle along a surface at a speed responsive to the frequency of the coil signal within the unique frequency band associated with the respective toy vehicle; and, a toy vehicle steering system responsive to the amplitude of the coil signal within the unique frequency band associated with the respective toy vehicle to steer the toy vehicle along a path or lane, separated from the wire loop by a distance responsive to the amplitude of the coil signal within the unique frequency band associated with the respective toy vehicle.

18. The toy vehicle of claim 17 wherein the manual toy vehicle controls are proportional controls.

19. A toy vehicle automatic navigation system comprising:

a single wire loop having one or more turns of wire;

a source of alternating electric current coupled to the wire loop, the wire loop providing an alternating magnetic field in response to the alternating electric current;

a plurality of toy vehicle manual controls coupled to the source of alternating current, each manual control having a manual steering control and a manual speed control;

an encoder/modulator coupled to the plurality of toy vehicle manual controls for encoding the plurality of steering control signals and the plurality of speed control signals as a serial data stream modulating the alternating electric current coupled to the wire loop;

the plurality of toy vehicles each comprising;

a pickup coil oriented on the vehicle to receive a coil signal responsive to the strength of the alternating magnetic field through the pickup coil;

a demodulator/decoder demodulating the coil signal and detecting the speed control signal and the steering control signal for the respective toy vehicle;

a propulsion system for propelling the toy vehicle along a surface at a speed responsive to the speed control signal for the respective toy vehicle; and, a toy vehicle steering system responsive to the steering control signal for the respective toy vehicle to steer the respective toy vehicle along a lane separated from the wire loop by a distance providing a coil signal corresponding to the steering control signal.

20. The toy vehicle of claim 19 wherein the manual toy vehicle control signals are discrete control signals.

* * * * *